US007468641B2

(12) United States Patent
Sorolla et al.

(10) Patent No.: US 7,468,641 B2
(45) Date of Patent: Dec. 23, 2008

(54) MICROWAVE BANDSTOP FILTER FOR AN OUTPUT MULTIPLEXER

(75) Inventors: Mario Sorolla, Castello (ES); Dietmar Schmitt, Wassenaar (NL); Marco Guglielmi, Wassenaar (NL); Javier Gil, Pamplona (ES); Noelia Ortiz Perez De Eulate, Alsasua (ES)

(73) Assignee: Agence Spatiale Europeenne, Paris (FR)

( * ) Notice: Subject to any disclaimer, the term of this patent is extended or adjusted under 35 U.S.C. 154(b) by 230 days.

(21) Appl. No.: 11/492,883

(22) Filed: Jul. 26, 2006

(65) Prior Publication Data

US 2007/0024394 A1 Feb. 1, 2007

(30) Foreign Application Priority Data

Jul. 27, 2005 (FR) ..... 05 08005

(51) Int. Cl.
*H01P 1/00* (2006.01)
*H01P 5/12* (2006.01)
*H01P 9/00* (2006.01)

(52) U.S. Cl. ..... 333/135; 333/122; 333/157; 333/208; 333/248

(58) Field of Classification Search ..... 333/122, 333/134–136, 157, 208–212, 248; 385/37
See application file for complete search history.

(56) References Cited

U.S. PATENT DOCUMENTS 2,912,695 A 11/1959 Cutler
3,046,503 A * 7/1962 Cohn ..... 333/210
3,082,384 A * 3/1963 Crane et al. ..... 333/209
3,263,116 A * 7/1966 Azam et al. ..... 315/3.6
3,597,710 A * 8/1971 Levy ..... 333/210

(Continued)

FOREIGN PATENT DOCUMENTS

DE 42 18 815 A1 12/1993

(Continued)

OTHER PUBLICATIONS

O.R. Asfar et al., "Microwave filter response of nonuniformly corrugated circular waveguide", Journal of Electromagnetic Waves and Applications, vol. 9, No. 1/2, 1995, pp. 127-143.

(Continued)

*Primary Examiner*—Benny Lee
*Assistant Examiner*—Kimberly E Glenn
(74) *Attorney, Agent, or Firm*—Clark & Brody

(57) ABSTRACT

A microwave bandstop filter comprises a waveguide segment of cross-section that presents longitudinal variation of sinusoidal type modulated by an amplitude function that is continuous, the period of said longitudinal variation of sinusoidal type being the Bragg period for the fundamental guided mode at a center frequency of the band to be stopped. A filter assembly comprises a microwave lowpass filter presenting a cutoff frequency and at least one interfering passband at frequencies higher than said cutoff frequency, and at least one bandstop filter as defined above, connected to the output of said lowpass filter, in which the amplitude and the period of said longitudinal variation, and also the length over which it extends are such that they stop said interfering passband of said lowpass filter. An output multiplexer for a multichannel microwave transmitter includes such a filter assembly.

16 Claims, 5 Drawing Sheets

U.S. PATENT DOCUMENTS

| | | | | |
|---|---|---|---|---|
| 4,745,617 | A | 5/1988 | Harvey | |
| 4,847,574 | A * | 7/1989 | Gauthier et al. | 333/21 A |
| 5,600,740 | A | 2/1997 | Asfar | |
| 5,942,956 | A * | 8/1999 | Haq et al. | 333/21 R |
| 6,118,978 | A * | 9/2000 | Ihmels | 455/12.1 |
| 6,191,670 | B1 | 2/2001 | Nguyen | |
| 6,285,267 | B1 * | 9/2001 | Hauth et al. | 333/210 |

FOREIGN PATENT DOCUMENTS

DE 4218815 A1 * 12/1993

EP 1492194 A1 * 12/2004

OTHER PUBLICATIONS

M. Ludovico et al., "Multipaction Analysis and Power Handling Evaluation in Waveguide Components for Satellite Antenna Applications", exp, vol. 1, No. 1, Dec. 2001, pp. 20-23.

N.F. Kovalev et al., "Wave Transformation in a Multimode Waveguide with Corrugated Walls", Radiophysics and Quantum Electronics, vol. 11, No. 5, 1968, pp. 449-450.

B.Z. Katsenelenbaum et al., "Theory of Nonuniform Waveguides, the cross-section method", IEEE Electromagnetic Wave Series, vol. 44, London, 1998.

* cited by examiner

FIG. 4A

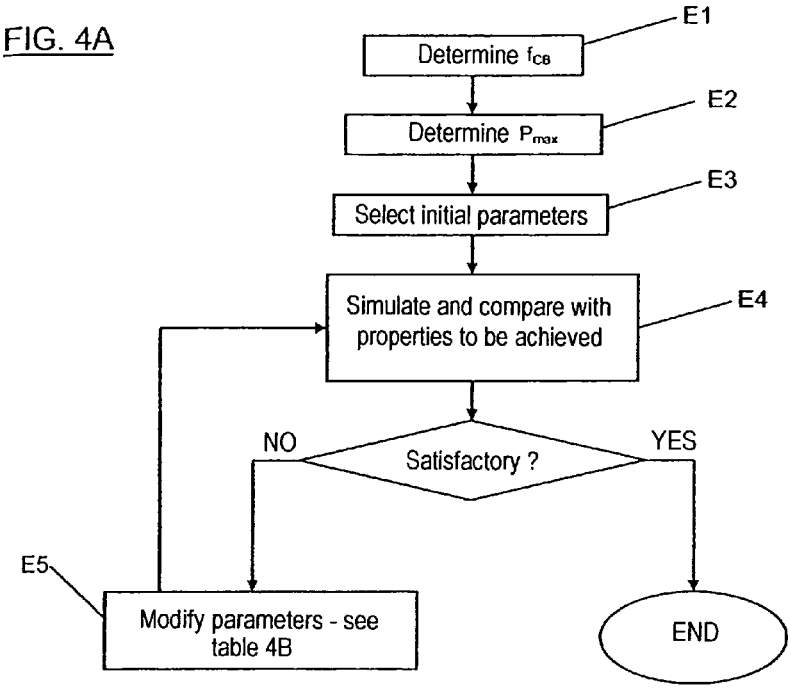

| | $A(f_{CB})>A'(f_{CB})$ | $A(f_{CB})\cong A'(f_{CB})$ | $A(f_{CB})<A'(f_{CB})$ |
|---|---|---|---|
| **LB>LB'** | – | – | Increase scale factor of P(x) |
| **LB≅LB'** | – | – | Increase amplitude without exceeding Pmax<br>Increase scale factor of P(x)<br>Introduce Φ(x) |
| **LB<LB'** | Decrease scale factor of P(x) | Decrease scale factor of P(x)<br>Increase amplitude without exceeding Pmax<br>Introduce Φ(x) | Increase amplitude without exceeding Pmax<br>Increase scale factor of P(x)<br>Introduce Φ(x) |

FIG. 4B

MICROWAVE BANDSTOP FILTER FOR AN OUTPUT MULTIPLEXER

The invention relates to a bandstop filter for operating in the microwave region of the spectrum, and more particularly in bands X to K or Ka, and enabling signals to be transmitted at high power, of kilowatt or higher order.

Such a filter is intended particularly, but not exclusively, for application to output multiplexers of transmitters in telecommunications satellites.

The invention also relates to a filter assembly including such a bandstop filter, and to an output multiplexer of a microwave multichannel transmitter including such a filter assembly.

BACKGROUND OF THE INVENTION

Microwave transmitters for telecommunications satellites use an output multiplexer (OMUX) for combining the various transmission channels. In modern systems, it can be necessary to combine as many as 18 or more channels, and since the power of each channel in the Ku band (12 gigahertz (GHz) to 18 GHz) generally lies in the range 150 watts (W) to 250 W, the output multiplexer must be capable of accommodating total power levels of several kilowatts. In general, such a multiplexer uses a common manifold structure for combining the various channels. At the common output from the manifold, non-linear effects, e.g. due to connection flanges, lead to the appearance of interference signals due to intermodulation and known as parasitic intermodulation products (PIMP) which can occur in the passband of the receiver. The traditional approach for reducing the magnitude of intermodulation products consists in providing, upstream from the common manifold, a lowpass filter for each channel, so as to eliminate the harmonics of the payload signal; in particular, it has been found necessary to eliminate interference signals at least up to the third harmonic.

In order to reduce the weight and size of the multiplexer, it would be preferable to use a common lowpass filter instead of individual filters for each channel. However, filters known in the prior art do not enable satisfactory filtering to be obtained while simultaneously conveying high power. Waveguide filters adapted for these applications, such as filters of the waffle iron type or corrugated waveguide type present interference passbands above the nominal cutoff frequency, and in particular at frequencies that are harmonics thereof. The magnitudes of these interfering passbands increase with increasing spacing or gap between the walls of the waveguide in the electric field direction of the waves being conveyed, which leads to operation of multimode type: consequently, in order to be effective in eliminating the undesirable frequencies, it is necessary to use filters with a small gap, but that is not possible in high power applications (power of kilowatt or greater order), in particular when the filter is to be used in a vacuum, because of the risk of electron avalanche discharges ("multipaction"). A discussion of the electron avalanche discharge phenomenon can be found in the article by M. Ludovico, G. Zarba, L. Accatino, and D. Raboso "Multipaction analysis and power handling evaluation in waveguide components for satellite antenna applications", exp, Vol. 1, No. 1, December 2001.

OBJECTS AND SUMMARY OF THE INVENTION

An object of the present invention is to make it possible to achieve effective filtering over a broad band at high frequencies even in high power applications, and to do using a device that presents a structure that is particularly simple and easy to make. By way of example, the invention makes it possible to obtain attenuation of at least 25 decibels (dB) over a band having a width of several gigahertz at frequencies greater than 15 GHz, while making use solely of a passive structure in the form of a waveguide.

The invention relies on the principle of Bragg reflection, which is already used in the field of microwaves for producing mode converters and filters, but has never been used in high power and broadband multimode filters, as in the present circumstances.

For example, the article "Wave transformation in a multimode waveguide with corrugated walls" by N. F. Kovalev, I. M. Orlova, and M. I. Petelin, Radiophysics and Quantum Electronics, Vol. 11, No. 5, pages 449-450 (1968) discloses using a waveguide with corrugated walls as a narrowband filter. The corrugations of the walls have a sinusoidal profile and a peak-to-peak amplitude that is approximately equal to 3.8% of the mean cross-section of the waveguide.

The use of waveguides with walls presenting sinusoidal disturbances as mode converters operating in narrow band and in overmoded or quasi-optical regime, is also described in the work by B. Z. Katsenelenbaum, L. Mercader del Rio, M. Pereyaslavets, M. Sorolla Ayza, and M. Thumm "Theory of non-uniform waveguides—the cross-section method", IEEE Electromagnetic Waves Series, Vol. 44, London (1998).

In addition, U.S. Pat. No. 5,600,740 discloses using a corrugated waveguide presenting a 180° phase jump as a narrow band bandpass filter.

The invention provides a microwave bandstop filter comprising a waveguide segment of cross-section that presents longitudinal variation of the sinusoidal type that is modulated by an amplitude function that is continuous, the period of said longitudinal variation of sinusoidal type being the Bragg period for the fundamental guided mode at a center frequency of the band to be stopped.

According to advantageous characteristics of the invention:

The waveguide segment may be a metal waveguide segment of rectangular cross-section, the longitudinal variation in said cross-section being obtained by symmetrical deformation of two opposite faces thereof, and preferably of the two opposite faces of the greatest length;

- the maximum amplitude of the variation of said cross-section may be such that the minimum spacing or gap between said two opposite walls lies in the range 30% to 70%, and preferably in the range 40% to 60% of the mean gap;
- said waveguide segment may extend over a length lying in the range ten periods to 30 periods of said longitudinal variation of sinusoidal type of the cross-section;
- said amplitude function may present a rising front and a falling front of slope that is sufficiently small for the coefficient of reflection at the input of said waveguide section is less than or equal to −20 dB for frequencies lower than those of said band that is to be stopped;
- said amplitude function may be selected from: a cosine-squared function, a cosine even-power function, a Gaussian function, and a Hamming, Kaiser-Müller, or Black window;
- said longitudinal variation of sinusoidal type in the cross-section of the waveguide segment may also present continuous phase modulation (or frequency modulation, since that constitutes a special case of phase modulation).

In a particular embodiment:

the mean transverse dimensions of the waveguide section constituting said or each bandstop filter and the maximum amplitude of the longitudinal variation of its cross-section are such that they enable power of at least 0.5 kW to be conveyed in the microwave region of the spectrum without any danger of electron avalanche discharges occurring in a vacuum; and the amplitude and the period of said longitudinal variation, and the length over which it extends, are such that they produce attenuation of at least 25 dB by Bragg reflection in a band having a width of at least 1 GHz.

Even more particularly, the mean transverse dimensions of the waveguide segment and the maximum amplitude of said longitudinal variation in its cross-section may be such that they enable power of at least 1 kW to be transmitted in the X and Ku bands without electron avalanche discharges occurring in a vacuum, and the amplitude and the period of said longitudinal variation, and the length over which it extends may be such that they produce attenuation of at least 25 dB by Bragg reflection in a band having a width of at least 1 GHz in bands K and higher.

The invention also provides a filter assembly comprising:

a microwave lowpass filter presenting a cutoff frequency and at least one interfering passband at frequencies higher than said cutoff frequency; and at least one band stop filter as defined above, connected to the output of said lowpass filter, in which the amplitude and the period of said longitudinal variation, and the length over which it extends are such that they stop said interfering passband of said lowpass filter.

Advantageously:

the mean transverse dimensions of the waveguide segment constituting said or each bandstop filter, and the maximum amplitude of the longitudinal variation in its cross-section are such that they enable power to be conveyed that is not less than the maximum output power from said lowpass filter without electron avalanche discharges occurring in a vacuum;

the cutoff frequency of said lowpass filter is situated in the Ku band, and said interfering band is situated in the K or Ka band; and said filter assembly comprises at least two filters as defined above, dimensioned to stop the interference band of said lowpass filter centered to correspond with the second and the third harmonics of its cutoff frequency.

The invention also provides an output multiplexer for a microwave multichannel transmitter including an output filter, wherein said output filter comprises such a filter assembly.

BRIEF DESCRIPTION OF THE DRAWINGS

Other characteristics, details, and advantages of the invention appear on reading the following description made with reference to the accompanying drawings, in which:

FIGS. 4A and 4B are diagrams showing a method of designing a bandstop filter of the invention.

MORE DETAILED DESCRIPTION

A bandstop filter of the invention is essentially constituted by a waveguide segment of cross-section that presents longitudinal variation of sinusoidal type, modulated by a continuous amplitude and/or phase function. If the cross-section of the waveguide segment is written S(x), where x is a longitudinal coordinate, it is then possible to write:

$$S(x)=S_0+P(x)\cdot\sin[\Omega_0\cdot x+\Phi(s)] \quad [1]$$

where:

$S_0$ is the mean section; and $P(x)\cdot\sin[\Omega_0\cdot x+\Phi(x)]$ represents the modulated sinusoidal variation.

Advantageously, the filter can be obtained from a waveguide of rectangular section such as, for example, a WR75 waveguide having sides of length a=19.05 millimeters (mm) and b=9.525 mm. Such a waveguide is generally used for propagating TE modes in which the electric field is perpendicular to the longest walls, which are consequently said to be "E-planes". It is observed that when such a waveguide is used in a band lying in the range 10 GHz to 15 GHz and above, it presents a multimode character.

Figure 1A:
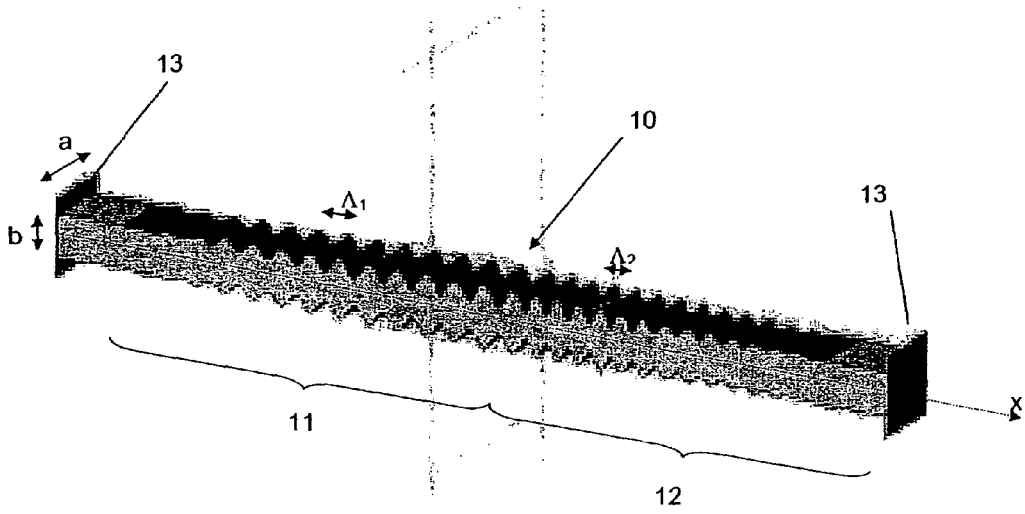
FIG. 1A is a perspective view of a first filter of the invention, constituted by a waveguide segment of cross-section that presents longitudinal variation of sinusoidal type modulated in amplitude and in frequency.

In the embodiment of the invention shown in FIG. 1A, the distance b between the E-planes of a segment 10 of a WR75 type waveguide, known as the spacing or "gap", depends on the longitudinal coordinate x in application of a relationship of the form:

$$b(x)=b_0+P(x)\cdot\sin[\Omega_0\cdot x\Phi(x)] \quad [2]$$

This disturbance is obtained by deforming the E-planes of the waveguide in symmetrical manner.

In this embodiment, the phase function $\Phi(x)$ is kept constant in a first region 11 of the segment 10, and then it increases linearly in a second region 12. That means that the almost sinusoidal disturbance period of the gap presents a first space period $\Lambda_1=2\pi/\Omega_0$ in the first region 11 and a second space period $\Lambda_2=2\pi/(\Omega_0+d\Phi/dx)$ in the second region 12, the connection between said regions taking place without phase discontinuity. More precisely, the first period $\Lambda_1=7.142$ mm corresponds to the Bragg period for an electromagnetic wave of frequency $f_1=23$ GHz propagating in the waveguide in the fundamental $TE_{10}$ mode, and the second period $\Lambda_2=5.26$ mm corresponds to the Bragg period for a wave of frequency $f_2=30$ GHz also propagation in $TE_{10}$ mode. It is recalled that the Bragg period $\Lambda_B$ for an electromagnetic wave of frequency f propagating with a guided wave number $\beta$ (f) is given by $\Lambda_B=\pi/\beta(f)$. When this condition is satisfied, the reflection coefficient of the wave is maximized.

The function of amplitude P(x) is a cosine-squared function of maximum amplitude equal to about $b_0/2=4.7625$ mm. The peak of the function P(x) corresponds to the interface between the first and second regions of the segment 10 and its first zeros to the level at the ends of said regions, beyond which it is truncated. Each region 11, 12 has fourteen periods of the corresponding disturbance.

Such a structure can accommodate conveying power of the order of 1 kW at a frequency of 10 GHz to 15 GHz without there being any risk of an electron avalanche discharge occurring.

Figure 1B:
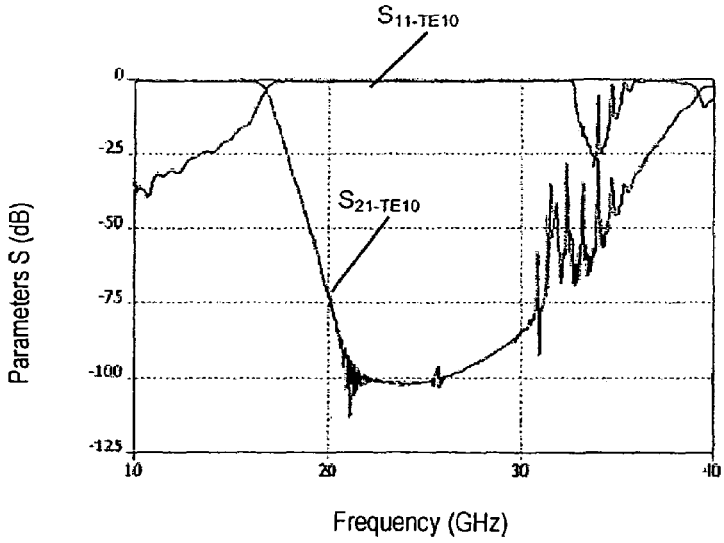
FIGS. 1B, 1C, and 1D are graphs showing the filter properties of the FIG. 1A device.

FIG. 1B shows the way the scattering parameters $S_{11}$ and $S_{21}$ for the $TE_{10}$ fundamental mode of the FIG. 1A device depend on frequency. The physical significance of these terms is recalled initially: if it is considered that an electromagnetic wave is injected at an input end 13 of the waveguide segment 10 in the form of a $TE_{10}$ mode wave, and that the output end 14 of said segment 10 is looped on a matched load, then $S_{11}$ represents the reflection coefficient and $S_{21}$ the transmission coefficient, for the $TE_{10}$ component of said wave.

The curves $S_{11\text{-}TE10}$ and $S_{21\text{-}TE10}$ show that the disturbance to the E-planes of the waveguide segment 10 reflects the spectral components of the input signal that lie in the range approximately 16 GHz to approximately 39 GHz, inducing attenuation that can reach 100 dB around 25 GHz. However, losses in the payload band of 10 GHz to 15 GHz remain very low ($S_{21\text{-}TE10}$ greater than −0.2 dB, even though this is not visible in the figure).

Figure 1C:
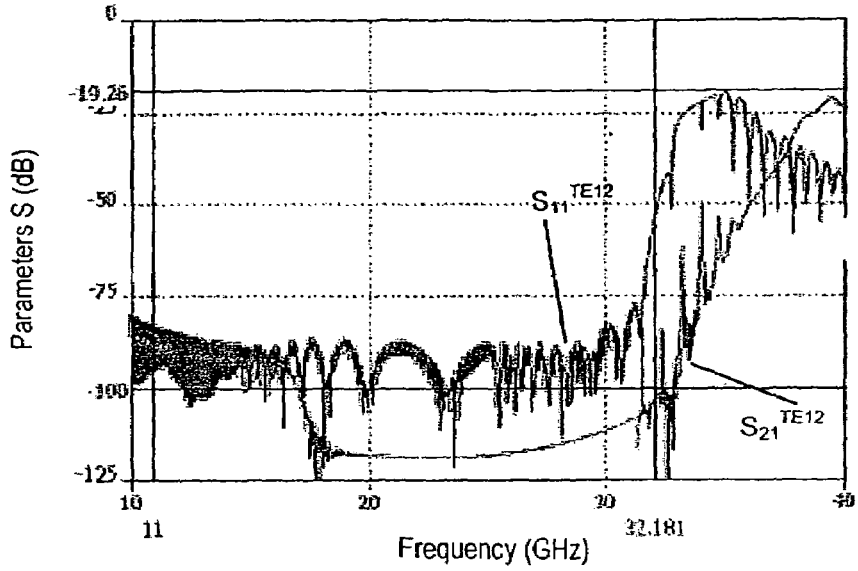
Figure 1D:
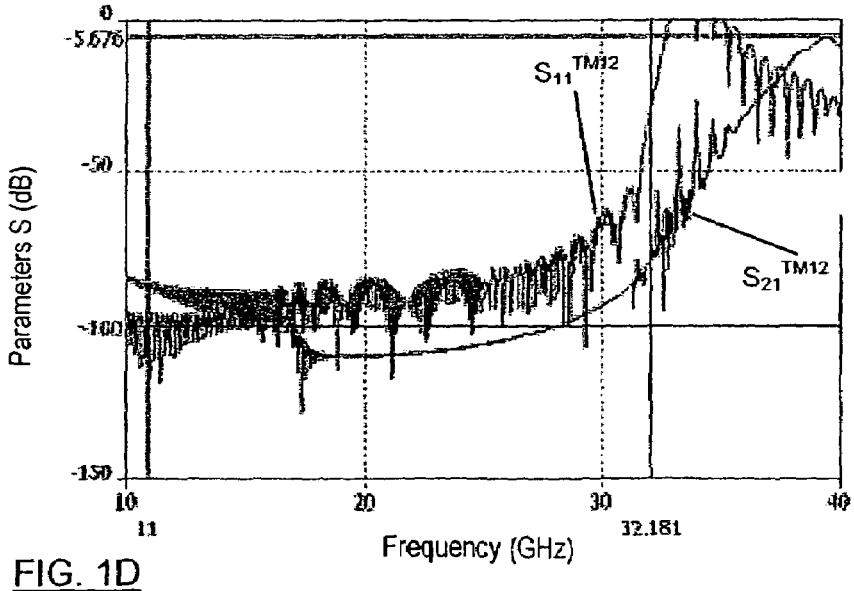

At around 33 GHz to 35 GHz, the curve $S_{11\text{-}TE10}$ presents a local minimum: in this region of the spectrum, conversion to higher modes contributes strongly to attenuation of the $TE_{10}$ mode being conveyed. FIGS. 1C and 1D show the parameters $S_{11}$ and $S_{21}$ for conversion of $TE_{10}$ to $TE_{12}$ mode and to $TM_{12}$ mode respectively (curve $S_{11}^{TE12}$ and $S_{21}^{TE12}$ on FIG. 1C, $S^{21TM12}$ and $S_{21}^{TM12}$ in FIG. 1C). It can be seen that mode conversion is negligible in the payload band of 10 GHz to 15 GHz, and up to about 30 GHz.

A filter of the above-described type can be dimensioned in such a manner as to stop a band that extends, for example, from 13 GHz to 39 GHz, and can be used directly as an output lowpass filter for a multiplexer for a microwave transmitter. However, such a filter would be large in size: the Bragg period becomes longer with reduction in the frequency of the radiation that is to be stopped, and consequently it would be necessary to use a waveguide segment that is relatively long, which is not desirable, particularly in space applications. Consequently, it is preferable to use a conventional filter, e.g. of the waffle-iron or corrugated waveguide type so as to eliminate frequencies in the range approximately 13 GHz to approximately 20 GHz. Unlike filters of the invention, which are characterized by quasi-sinusoidal corrugations distributed over a relatively long length, such structures present sudden changes of section, making it possible to obtain large attenuation over a short length. Nevertheless, and as mentioned above, such conventional filters inevitably present interfering passbands above the nominal cutoff frequency, particularly when they are adapted to operate at high powers (large gap). The Bragg filters of the invention are particularly suitable for stopping said interfering passbands: since those bands occur at high frequencies, their Bragg period is relatively short, thus leading to structures that are compact. For example, for transmission in X band (8 GHz to 12 GHz) or in KU (12 GHz to 18 GHz), filters of the invention can be dimensioned to operate in the K band (18 GHz to 26 GHz) and in the Ka band (26 GHz to 40 GHz).

Figure 2A:
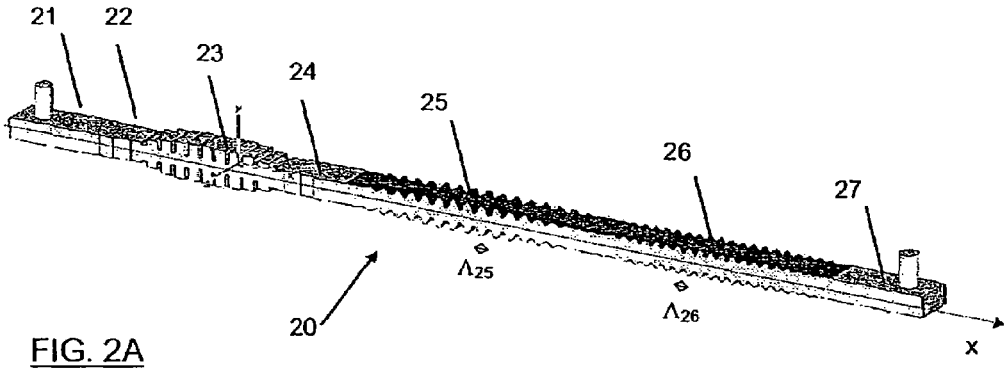
FIG. 2A is a perspective view of a filter assembly of the invention constituted by a cascade connection of a prior art lowpass filter and two waveguide segments of cross-section presenting longitudinal variation of amplitude modulated sinusoidal type.

FIG. 2A thus shows a filter assembly 20 comprising: an input waveguide segment 21, a lowpass filter having a corrugated waveguide 23 provided with two impedance-matching sections 22 and 24, first and second bandstop filters of the invention (respectively 25 and 26), and an output waveguide segment 27.

The lowpass filter 22 is known in the prior art and presents a cutoff frequency at 13 GHz; in order to be capable of accommodating powers of the order of several kW, the minimum gap between the E-planes is relatively large (4.75 mm), thus causing interfering passbands to appear at frequencies greater than 20 GHz. The two filters 25 and 26, both constituted by a segment of WR75 waveguide with gap presenting longitudinal variation in application of equation [2], are dimensioned in such a manner as to eliminate said interfering passband up to a frequency of 39 GHz, which corresponds to the 3rd harmonic of the "primary" filter 22. More precisely, the quasi-sinusoidal disturbance of the filter 25 presents 17 periods of length $\Lambda_{25}$=7 mm, corresponding to the Bragg period for radiation of 21 GHz propagating in $TE_{10}$ mode, modulated by a cosine-squared amplitude function having a maximum amplitude of 2.1 mm. In similar manner, the quasi-sinusoidal disturbance of each E-plane of the filter 26 consists in 22 periods of length $\Lambda_{26}$=5.26 mm (Bragg period for radiation at 30 GHz), likewise modulated by a cosine-squared amplitude function having a maximum amplitude equal to 1.3 mm. With a WR75waveguide, this leads to a minimum gap of 5.325 mm, which is greater than that of the filter 22 (4.75 mm). In both configurations, the phase function $\Phi(x)$ is constant, which means that the longitudinal disturbance does not present any phase modulation.

Figure 2B:
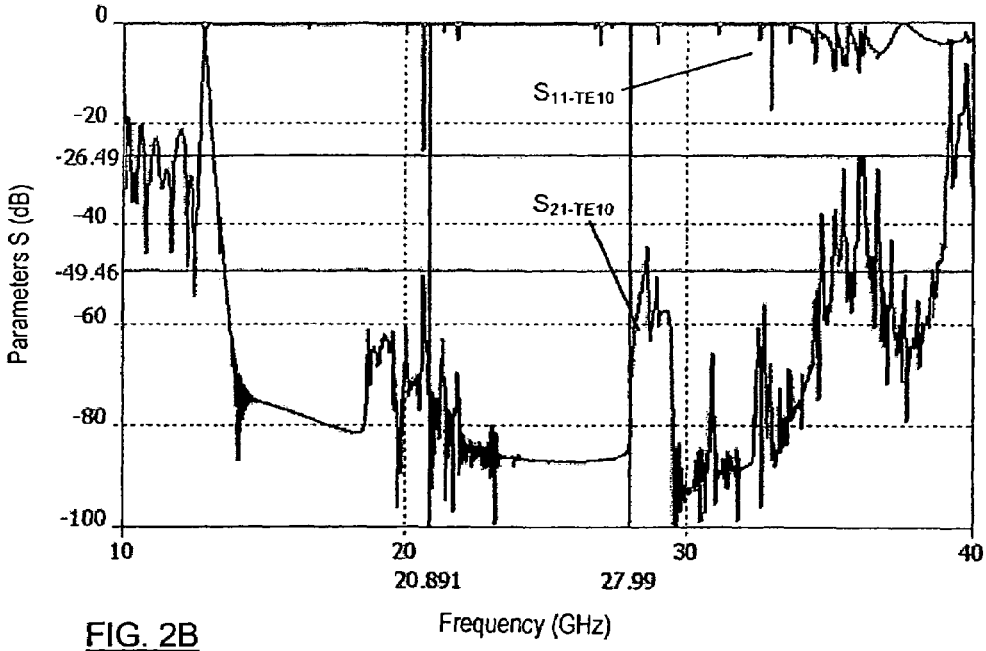
FIGS. 2B and 2C are graphs showing the filter properties of the FIG. 2A assembly.

FIG. 2B shows how the parameters $S_{11}$ and $S_{21}$ for the $TE_{10}$ fundamental mode of the filter assembly 20 depend on frequency (curves $S_{11\text{-}TE10}$ and $S_{21\text{-}TE10}$). It can be seen that the interfering passbands are stopped efficiently (attenuation greater than 25 dB) up to a frequency of 39 GHz, corresponding to the 3rd harmonic of the cutoff frequency of the filter 23 (13 GHZ) . At the same time, losses in the passband (10 GHz to 13 GHz) remain limited to less than −20 dB.

Since the waveguide segments 25 and 26 present a gap that is greater than $b_0/2$ at all points, and furthermore they do not include any sudden changes of section, these elements of the filter assembly present little tendency to cause electron avalanche discharges. The element which limits the maximum power that can be conveyed by the assembly to about 1 kW is the lowpass filter 22 because of its small minimum gap and its corrugations of rectangular profile.

Figure 2C:
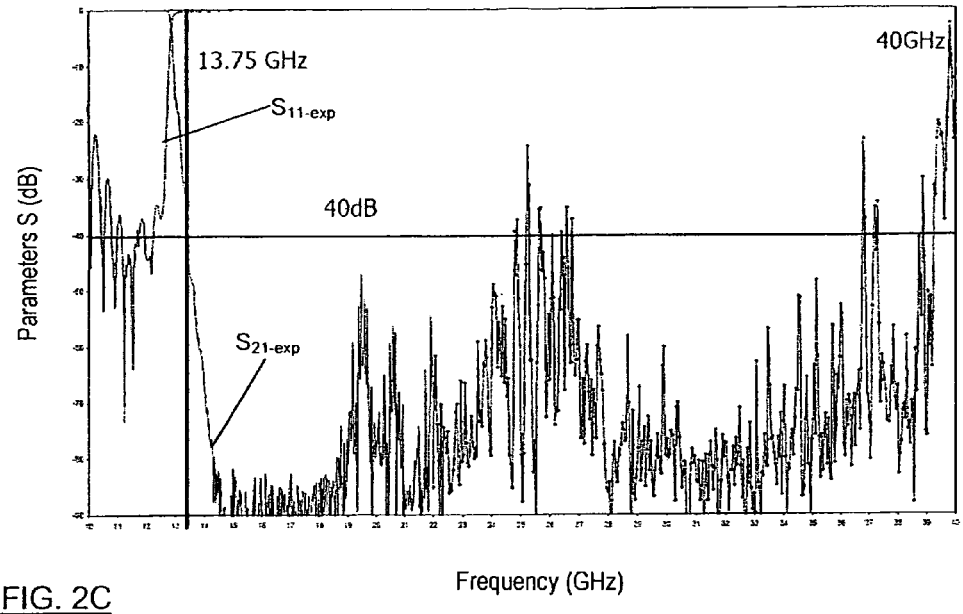

FIG. 2C shows the result of measurements of the parameters $S_{11}$ (curve $S_{11\text{-}exp}$) and $S_{21}$ (curve $S_{21\text{-}exp}$) taken on a prototype of the filter assembly 20 of FIG. 2A. It can be seen that attenuation of more than 40 dB is obtained in a band extending from about 13.75 GHZ to about 39 GHz, which frequency corresponds to the third harmonic of the upper limit of the payload band (13 GHz). Attenuation drops to below 40 dB only over two very narrow bands around 25 GHz and 37 GHz, and always remains greater than 20 dB.

Figure 3:
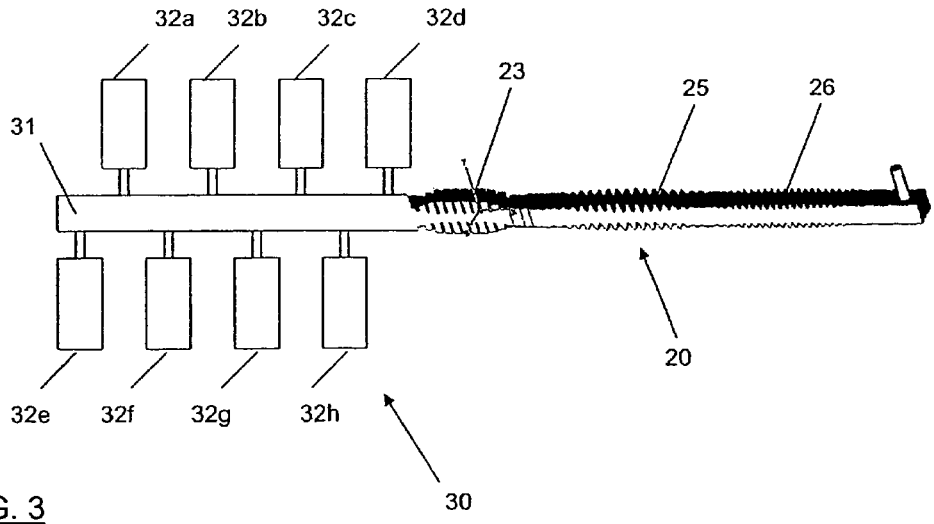
FIG. 3 is an output multiplexer comprising a filter assembly of the type shown in FIG. 2A.

As explained above, a filter assembly of the FIG. 2A type is particularly well adapted for use in making output multiplexers for microwave multichannel transmitters. FIG. 3 is a diagram of such a multiplexer 30, which is constituted essentially by a manifold 31 having connected thereto microwave signal generators 32*a*-32*h*, each corresponding to one transmission channel. In the prior art, between each generator 32*a*-32*h* and the manifold 31, it is necessary to interpose a lowpass filter for stopping the harmonics of the payload signal so as to prevent parasitic intermodulation signals appearing; the invention makes it possible to eliminate these filters, or at least to simplify them considerably. A multiplexer 30 of the invention comprises, at the outlet from the manifold 31, a filter assembly 20 of the kind described with reference to FIG. 2A. Such a filter assembly comprises a single lowpass filter 23 replacing the filters that used to be provided for each of the individual transmitters; compared with those filters, the filter 23, which must be capable of conveying much higher power, inevitably presents a transfer function that is less good, characterized by relatively large interfering passbands. The bandstop filters 25 and 26 make it possible to stop those interfering passbands without limiting the maximum power that can be conveyed. The use of a single filter assembly 20 replacing the plurality of filters associated with the generators 32*a*-32*h* makes it possible significantly to reduce the weight and the size of the multiplexer 30, and that is particularly important for space applications.

When designing a bandstop filter of the invention, the type of waveguide that needs to be used is generally imposed by the specific application under consideration: it will generally be a rectangular waveguide, however waveguides of circular section or ridged waveguides may also be used. Under such circumstances, dimensioning consists essentially in determining:

- the spatial frequency $\Omega_0$ of the quasi-sinusoidal disturbance;
- the form of the amplitude function P(x), e.g. a cosine-squared function or a Gaussian function;
- its longitudinal scale factor, i.e. the length over which $P(x)\neq 0$, and consequently the number of periods of the disturbance;
- its peak amplitude, which in turn determines the maximum reduction in the cross-section of the waveguide; and
- the possible presence of any phase modulation $\Phi(x)$ in such a manner as to satisfy certain conditions:
  - minimum attenuation over a band of determined width;
  - maximum acceptable level of losses in the payload band; and
  - maximum power level that can be conveyed without risk of an electron avalanche discharge.

Determining the "spatial frequency" $\Phi_0$ generally does not pose any particular problem: it is determined so as to satisfy the Bragg condition $\Omega_0=2\beta(f_{CB})$ for a frequency $f_{CB}$ situated approximately in the middle of the band to be stopped.

The number of periods of the disturbance constitutes a compromise between two contradictory requirements: a high number of periods makes it possible to reflect effectively the radiation at the center frequency $f_{CB}$ even in the presence of disturbances of small amplitude, but it also determines filtering over a narrow band. In order to stop a band that is of sufficient width (1 GHz and more) centered about $f_{CB}$, it is therefore necessary to use a limited number of periods, but that reduces the reflection coefficient for a disturbance of given amplitude. Simultaneously, it is not possible to increase said amplitude of the disturbance beyond a certain limit without running the risk of electron avalanche discharges appearing at the maximum operating power. Typically, it is therefore necessary to use disturbances extending over ten to 30 periods with a maximum amplitude lying in the range 30% to 70% and preferably in the range 40% to 60% of the mean gap $b_0$ of the waveguide.

The amplitude function P(x) generally cannot be a simple rectangular function since that would induce losses by reflection in the passband and lead to excessive conversions to higher order modes. It is therefore appropriate to use continuous functions presenting "gentle" transitions and rising and falling fronts having slopes that are small enough. It is observed that in high power applications, reflection losses in the passband are particularly harmful since as well as attenuating the signals being conveyed, they can damage the transmitters by reflecting back to them too great a fraction of the power they transmit. In the embodiments described above, the amplitude function P(x) has a cosine-squared form. Other suitable forms are cosine even powers greater than 2, giving steeper rising and falling fronts and a central region that is almost constant, Gaussian functions, and Hamming, Kaiser-Müller, or Black windows. Generally, the particular form chosen is not critical.

Phase modulation $\Phi(x)$ can be used subsequently to enlarge the filter band. To limit losses in the payload band and conversions to higher order modes, this function must also be continuous and present transitions that are "gentle". Phase modulation can impart linear frequency modulation ("chirp") or a continuous connection between two sinewaves of different periods, as in the example of FIG. 1A.

A rational method of dimensioning a filter of the invention can be described with the help of the flow chart of FIG. 4A and the table of FIG. 4B.

The first step E1 consists in determining a "center" frequency $f_{CB}$ of the band to be stopped, and in determining its guided wave number at the fundamental mode of the guide, $\beta(f_{CB})$. This makes it possible to calculate the "spatial frequency" $\Omega_0$ of the disturbance.

The following step, E2, consists in determining the maximum amplitude $P_{max}$ of the quasi-sinusoidal disturbance of the waveguide that is compatible with the requirements in terms of power conveyed.

Step E3 consists in selecting a form, a peak value, and a longitudinal scale factor for an amplitude function P(x), said peak value being less than the maximum amplitude $P_{max}$ as determined in the preceding step. This selection can be made in relatively random manner, however it is clear that experience can be a guide towards determining initial values that enable the dimensioning method to converge quickly. The exact form of the amplitude function P(x) is rarely critical, at least during the initial design stage. optionally, the dimensioning method can be repeated for different forms of P(x) in order to optimize the response of the filter for a determined application.

For reasons of simplicity, it is appropriate to assume initially that $\Phi(x)$=constant.

Step E4 comprises using numerical simulations to calculate the transfer function of the filter as obtained and to compare it with requirements in terms of the filter properties that are to be achieved. If the result is satisfactory, the method is terminated, otherwise it is necessary to modify at least some of the parameters in step E5.

Table 4B shows how the longitudinal scale factor of P(x), its peak value, and phase modulation $\Phi(x)$ can be modified. To do this, it is determined whether the attenuation in the center of the band $A(f_{CB})$ and the width LB of the stopband are substantially greater than, approximately equal to, or less than the required minimum values $A(f_{CB})'$ and LB'.

If $A(f_{CB})\geqq A(f_{CB})'$ and $LB\geqq LB'$, it is not necessary, at least initially, to modify the longitudinal scale factor of P(x), or its peak value, nor is it necessary to introduce a term in $\Phi(x)$.

If the attenuation in the center of the band $A(f_{CB})$ is insufficient while the width of the attenuated band is wider than necessary, it is possible to increase the scale factor P(x) and thus the number of disturbance periods. It is also possible to increase the peak value of P(x), providing the maximum value $P_{max}$ is not exceeded.

If the attenuation at the center of the band $A(f_{CB})$ is insufficient while the width of the attenuated band is itself hardly sufficient, it is necessary to increase the peak value of P(x). If that is not possible, it is necessary to increase the scale factor and to correct the resulting band narrowing by introducing phase modulation $\Phi(x)$. This phase modulation can be determined by selecting additional frequencies within the band to be stopped, by determining the corresponding Bragg periods, and by connecting together sinusoidal disturbances presenting said periods while guaranteeing phase continuity. Additional frequencies are added until a band of desired width is obtained. The device of FIG. 1A shows phase modulation of this type.

If the width of the attenuation band is insufficient and the attenuation at the center of the band is greater than required, it is possible to reduce the scale factor of P(x) and thus the number of disturbance periods, without modifying the amplitude.

In contrast, if the width of the attenuation band is insufficient, but the attenuation at the center of the band is hardly sufficient, or even insufficient, it is necessary to decrease the scale factor of P(x) and simultaneously to increase its peak value. If that is not possible because of the power limitations that would then arise, it is necessary to keep the number of disturbance periods constant and to introduce frequency modulation in order to broaden the attenuated band.

If both $A(f_{CB})$ and LB present values that are satisfactory, but the losses in the passband or the conversion coefficients to higher order modes are excessive, it is necessary to change the form of the amplitude function P(x), and possibly also of the phase function Φ(x), by selecting a function that presents transitions that are "gentler" with rising and falling fronts presenting smaller slopes.

Modifications are carried out iteratively, with the transfer function of the structure being recalculated on each occasion.

What is claimed is:

1. A microwave bandstop filter comprising a waveguide segment of cross-section that presents longitudinal variation of the sinusoidal type that is modulated by an amplitude function that is continuous, a period of said longitudinal variation of sinusoidal type being the Bragg period for a fundamental guided mode at a center frequency of a band to be stopped, wherein a maximum longitudinal variation in the cross-section of the waveguide lies in the range 30% to 70% of the mean gap of the waveguide segment.

2. A filter according to claim 1, in which the longitudinal variation in the cross-section of the waveguide lies in the range 40% to 60% of the mean gap of the waveguide segment.

3. A filter according to claim 1, in which the waveguide segment is a waveguide segment suitable for conveying a plurality of transverse modes in the spectral band to be stopped.

4. A filter according to claim 1, in which the waveguide segment is a metal waveguide segment of rectangular cross-section, the longitudinal variation in said cross-section being obtained by symmetrical deformation of two opposite faces thereof.

5. A filter according to claim 4, in which the longitudinal variation of said cross-section is obtained by symmetrical deformation of the two opposite faces of greatest length.

6. A filter according to claim 1, in which said waveguide segment extends over a length lying in the range ten periods to 30 periods of said longitudinal variation of sinusoidal type in its cross-section.

7. A filter according to claim 1, in which said amplitude function presents a rising front and a falling front of slope that is sufficiently small for the reflection coefficient at the input of said waveguide segment to be less than or equal to −20 dB for frequencies below those of said band to be stopped.

8. A filter according to claim 1, in which said amplitude function is selected from: a cosine-squared function, a cosine even-power function, a Gaussian function, and a Hamming, Kaiser-Müller, or Black window.

9. A filter according to claim 1, in which said longitudinal variation of sinusoidal type in the cross-section of the waveguide segment also presents phase modulation that is continuous.

10. A filter according to claim 1, in which;

mean transverse dimensions of the waveguide segment and the maximum amplitude of said longitudinal variation of the waveguide segment cross-section are such as to enable the waveguide segment to convey a power of at least 0.5 kW in the microwave region of the spectrum without electron avalanche discharges occurring in a vacuum; and an amplitude and a period of said longitudinal variation, and also a length over which a said longitudinal variation extends are such to produce attenuation of at least 25 dB by Bragg reflection in a band having a width of at least 1 GHz.

11. A filter according to claim 10, in which:

mean transverse dimensions of the waveguide segment and the maximum amplitude of said longitudinal variation of the waveguide segment cross-section are such to enable power of at least 1 kW to be conveyed in the X and Ku bands without electron avalanche discharges occurring in a vacuum; and an amplitude and a period of said longitudinal variation, and a length over which said longitudinal variation extends, are such to produce attenuation of at least 25 dB by Bragg reflection in a band having a width of at least 1 GHz in the K and higher bands.

12. A filter assembly, comprising:

a microwave lowpass filter presenting a cutoff frequency and at least one interfering passband at frequencies higher than said cutoff frequency; and at least one band stop filter according to claim 1, connected to the output of said lowpass filter, in which an amplitude and a period of said longitudinal variation, and a length over which said longitudinal variation extends are such to stop said interfering passband of said lowpass filter.

13. A filter assembly according to claim 12, in which mean transverse dimensions of the waveguide segment constituting said or each of said bandstop filter, and a maximum amplitude of the longitudinal variation in the waveguide segment cross-section are such to enable power to be conveyed that is not less than a maximum output power from said lowpass filter without electron avalanche discharges occurring in a vacuum.

14. A filter assembly according to claim 12, in which the cutoff frequency of said lowpass filter is situated in the Ku band, and said interfering band is situated in the K or Ka band.

15. A filter assembly according to claim 12, comprising at least two filters, each filter comprising a waveguide segment of cross-section section that presents longitudinal variation of the sinusoidal type that is modulated by an amplitude function that is continuous, the period of said longitudinal variation of sinusoidal type being the Bragg period for the fundamental guided mode at a center frequency of the band to be stopped, wherein the maximum longitudinal variation in the cross-section of the waveguide lies in the range 30% to 70% of the mean gap of the waveguide and dimensioned to stop the interfering bands of said lowpass filter centered to correspond with the second and third harmonics of lowpass filter cutoff frequency.

16. An output multiplexer for a multichannel microwave transmitter having an output filter, wherein said output filter comprises a filter assembly according to claim 12.

* * * * *